United States Patent [19]

Sakamaki et al.

[11] 4,274,817

[45] Jun. 23, 1981

[54] ROTARY VANE PUMP WITH INLET AND DISCHARGE PORTS IN END SEALING PLATES

[75] Inventors: Hiroshi Sakamaki, Utsunomiya; Toshiyuki Maeda, Ageo; Fumihiro Ushijima; Tadashi Saitou, both of Toyota, all of Japan

[73] Assignee: Toyota Jidosha Kogyo Kabushiki Kaisha, Toyota, Japan

[21] Appl. No.: 45,356

[22] Filed: Jun. 4, 1979

[30] Foreign Application Priority Data

Jun. 6, 1978 [JP] Japan ..... 53/68111

[51] Int. Cl.[3] ..... F04C 27/00; F04C 29/00

[52] U.S. Cl. ..... 418/133; 418/153

[58] Field of Search ..... 418/131–135, 418/153, 156

[56] References Cited

U.S. PATENT DOCUMENTS

| | | | |
|---|---|---|---|
| T927009 | 10/1974 | Ulrich | 418/133 |
| 2,762,340 | 9/1956 | Roggenburk | 418/133 |
| 3,024,736 | 3/1962 | Erdmann | 418/133 |
| 3,216,363 | 11/1965 | Snow et al. | 418/135 |
| 3,479,962 | 11/1969 | Pettibone | 418/133 |

*Primary Examiner*—John J. Vrablik

*Attorney, Agent, or Firm*—Sughrue, Rothwell, Mion, Zinn & Macpeak

[57] ABSTRACT

A rotary pump having a housing with a cylindrical cavity and end heads at each end to form a pump cavity. A drive shaft journaled by bearings carries a rotor having a number of movable vanes. Seal plates at each end of the pump cavity to divide it into a pair of end chambers defined by the seal plates and the end heads. Fluid inlet and discharge ports are provided in the sealing plates. The ports are formed as protrusions in the end plates towards the end chambers, as recesses therein or extending as openings into the end heads.

8 Claims, 6 Drawing Figures

ROTARY VANE PUMP WITH INLET AND DISCHARGE PORTS IN END SEALING PLATES

BACKGROUND OF THE INVENTION

This invention relates to a rotary fluid pump in which fluid intake, compression and discharge operations are carried out by the movement of vanes accompanied by the rotation of a rotor. More particularly, this invention relates to a type thereof wherein a pair of resilient sealing plates are sealingly disposed each between a main body of a stator housing and end head to define end chambers each between the sealing plate and a recessed portion of the end head.

Within the prior art rotary fluid pumps have been provided with a rotor chamber defined between the main body of the housing and end heads disposed at both sides of the housing. A rotor is rotationally supported in the housing by a drive shaft supported by bearings in a cantilevered manner or in an inboard manner. a plurality of vane grooves are formed in the rotor to slidingly receive an equal number of the vanes adapted to move along the radial direction of the rotor contacting with the inner peripheral surface of the main body or of a sleeve force-fitted with the main body. These vanes are rotated together with the rotation of the rotor to thereby perform fluid intake, compression and discharge operations.

According to such a prior art pump, sealability between side faces of the rotor and the end heads is particularly important, and therefore, resilient sealing plates are sealingly disposed between the main body of the housing and the end head. Further, a pair of end chambers are provided each between the sealing plate and the end head to allow resilient deformation of the sealing plates, to thereby ensure a seal between the side faces of the rotor and the seal plates.

The rotary fluid pump having sealing plates generally forms fluid inlet and outlet ports in the main body of the housing. With this structure, since radially outer end portions of the vanes permit sliding contact with the inner peripheral surface of the housing, stepped portions are created on the end portion of the vanes at the position corresponding to the inlet and outlet ports. The stepped portion due to wear differential may degrade sealability between the vanes and the inner peripheral surface of the main body.

In order to obviate this drawback, fluid inlet and outlet ports are formed in the seal plate(s) and fluid intake and discharge holes are formed in the end head(s) to introduce and discharge fluid into and from the rotor chamber through the end chamber(s). However, grease in the bearing disposed in a bearing support portion of the end head may be sucked by intake pressure or the grease may be expelled therefrom by the discharging pressure.

SUMMARY OF THE INVENTION

It is therefore, an object of this invention to overcome the above-mentioned drawbacks and to provide an improved rotary fluid pump in which grease leakage from the bearings is prevented.

It is another object of this invention to provide a rotary fluid pump having improved service life of the bearings and excellent pump efficiency prohibiting the generation of a stepped portion at the radially outer end portion of the vanes.

These and other objects in accordance with this invention are obtained by providing fluid inlet and outlet passages at the sealing plates. These passages are in communication with the rotor chamber while fluid communication with the end chambers are blocked. The fluid sucked from the fluid inlet passage is introduced into the rotor chamber and is discharged therefrom through the fluid outlet passage without fluid communication with the end chambers.

These and other objects of this invention will become apparent from the description of the drawings and the preferred embodiments which follow.

DETAILED DESCRIPTION OF THE PREFERRED EMBODIMENTS

Figure 1:
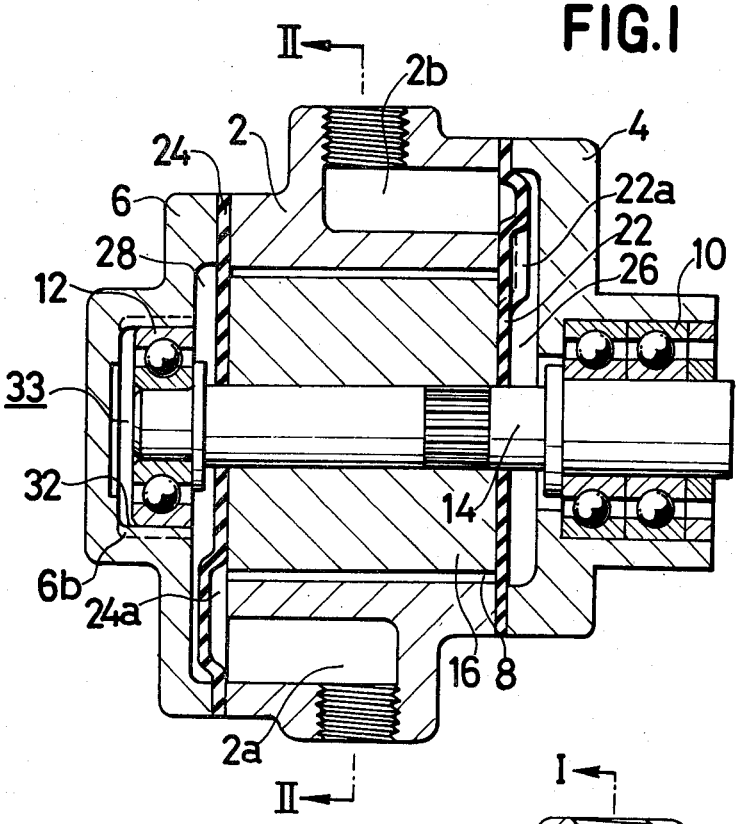
FIG. 1 shows a cross-sectional elevation taken along the line I—I of FIG. 2, illustrating a rotary fluid pump according to a first embodiment of this invention.
Figure 2:
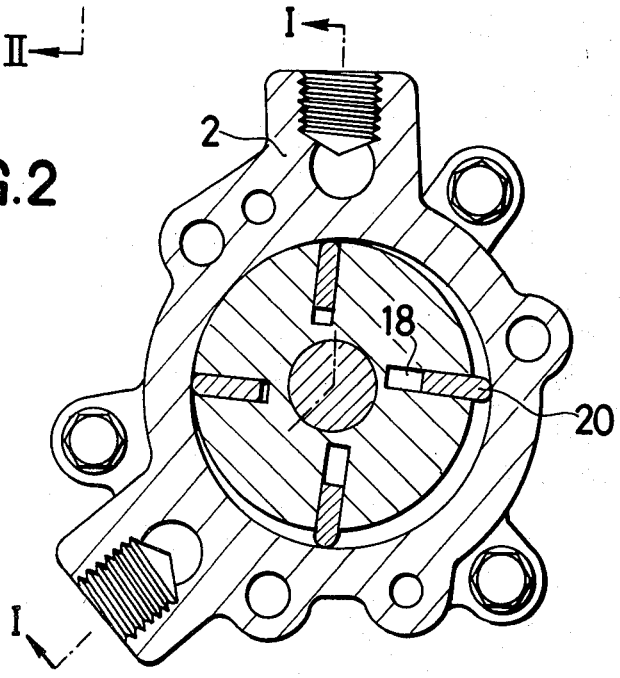
FIG. 2 shows a transverse cross-sectional elevation taken along the line II—II of FIG. 1.

The first embodiment according to this invention is shown in FIGS. 1 through 4, wherein a rotor chamber 8 is defined by a main body 2 of a housing and end heads 4, 6 fixedly secured to the main body 2 by bolts (not shown). A rotor 16 is rotationally supported in the rotor chamber 8 by a drive shaft 14 supported by bearings 10, 12. As shown in FIG. 2, four vane grooves 18 are formed in the rotor 16 to slidingly receive vanes 20 therein.

Resilient sealing plates 22, 24 are sealingly disposed between the end heads 4, 6 and the main body 2. Each of the end heads 4, 6 is formed with a recessed portion to provide end chambers 26, 28 defined with the sealing plates 22, 24. Further, the end heads 4, 6 form bearing insertion holes 32. These structures are well known in the pump art.

According to this invention, fluid inlet and outlet passages are provided in the sealing plates. These inlet passages protrude toward the end chambers but no fluid communication with the end chambers is established.

Figure 3:
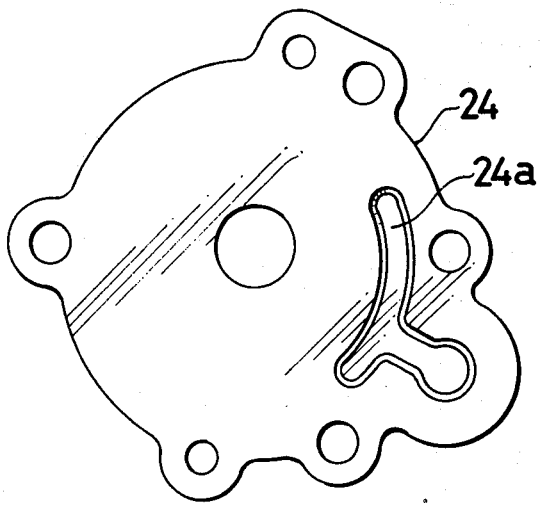
FIG. 3 shows a plan view of a sealing plate having a fluid intake port used in the first embodiment shown in FIG. 1.
Figure 4:
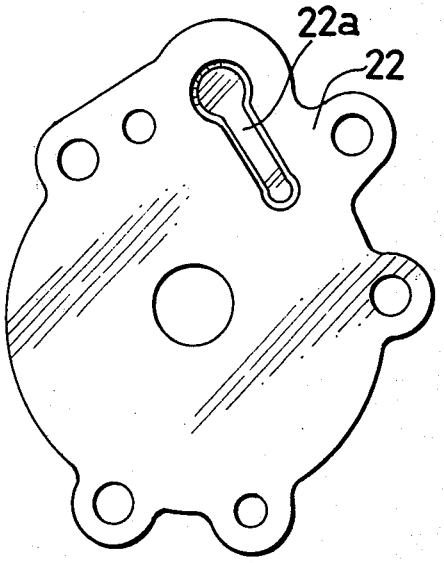
FIG. 4 shows a plan view of a sealing plate having a fluid outlet port used in the first embodiment shown in FIG. 1.

According to the first embodiment, a fluid inlet passage **24*a* is formed at the rear side sealing plate 24 and a fluid outlet passage 22*a* is formed at the front side sealing plate 22. As shown in FIGS. 3 to 4, the passages 22*a* and 24*a* protrude toward the end chambers 26, 28** to block fluid communication therewith. These passages are defined by providing concave portions having random shape in the sealing plates.

The main body 2 is formed with a fluid intake space **2*a* in fluid communication with the rotor chamber 8 through the fluid inlet passage 24*a*, and a fluid discharge space 2*b* in fluid communication with the rotor chamber 8 through the fluid outlet passage 22*a*. Since the end chambers 26, 28 are not in fluid communication with that fluid path, grease leakage from the bearings 10, 12 is prevented and the grease cannot enter the rotor chamber. Furthermore, since fluid intake and discharge spaces 2***a*, 2*b* are provided in the main body, a compact pump may be constructed to reduce space and volume problems encountered, for example in the engine compartment of a vehicle.

In the first embodiment, inlet and outlet passages are formed in the different sealing plates. However, it is apparent that these passages can be formed in the one of the sealing plates. Alternatively, each of the sealing plates can provide inlet and outlet passages.

Figure 5:
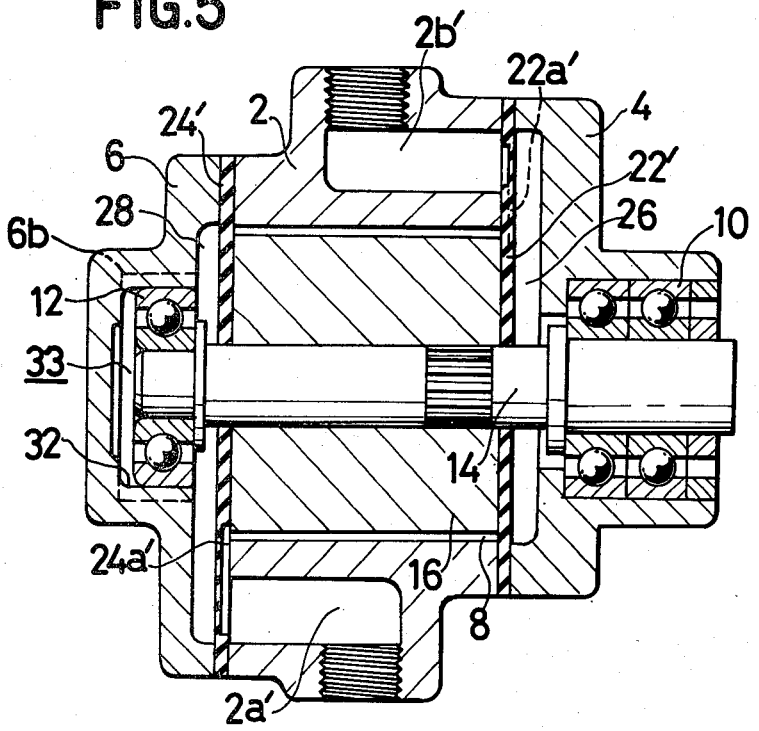
FIG. 5 shows a cross-sectional elevation of a rotary fluid pump according to a second embodiment of this invention.

A second embodiment of this invention is shown in FIG. 5, wherein like parts and components are designated by the same reference numerals and characters as those shown in the first embodiment. In the second embodiment, recesses 22*a*', 24*a*' are formed in the inner side face of the seal plates 22', 24', respectively to permit fluid communication between the rotor chamber 8 and the fluid intake and discharge space 2*a*', 2*b*' therethrough. Such recesses 22*a*', 24*a*' can also be formed in one of the sealing plates or each of the sealing plates can provide recesses which function as fluid inlet and outlet passages.

Figure 6:
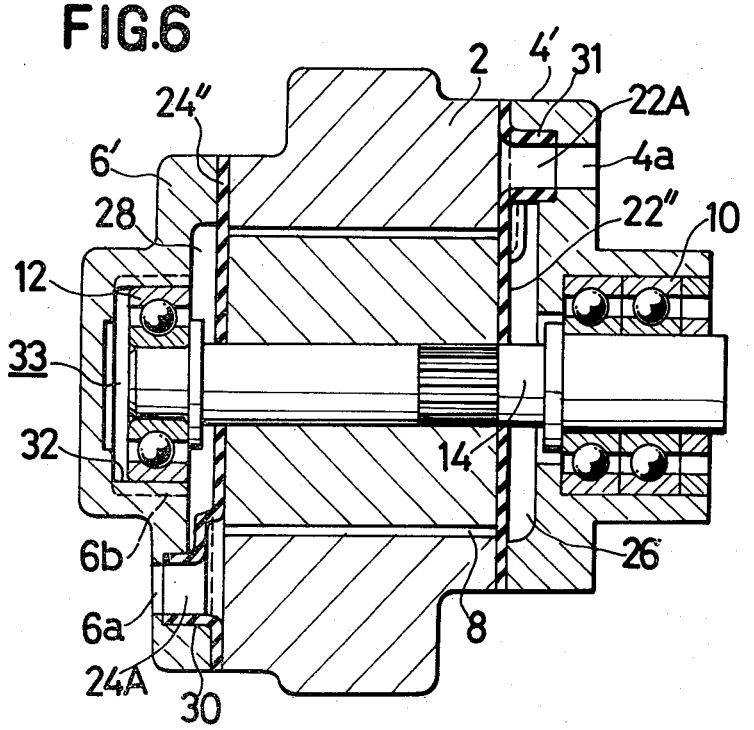
FIG. 6 shows a cross-sectional elevation of a rotary fluid pump according to a third embodiment of this invention.

A third embodiment according to this invention is shown in FIG. 6, wherein fluid intake and discharge spaces provided in the foregoing embodiments are not provided. Instead, a fluid intake port 6*a* and discharge port 4*a* are formed in the end heads 6', 4', respectively. Further, seal plates 24'', 22'' are partially extended outwardly to provide fluid intake openings 24A, and discharge openings 22A, each connected to the fluid intake and discharge ports 6*a*, 4*a*, respectively. The fluid intake and discharge ports 6*a*, 4*a* are formed with annular stepped portions 30, 31 to which intake and discharge openings 24A, 22A are force fitted.

With this structure, fluid from the fluid intake port 6*a* is supplied into the rotor chamber 8 through the intake opening 24A, and is discharged from the fluid discharge port 4*a* through the fluid discharge opening 22A without fluid communication with the end chambers 28, 26.

It is apparent that the intake and discharge openings 24A, 22A can be formed in one of the seal plates. Further, in all of the embodiments, bearings 10, 12 are accomodated in the bearing support holes in the end heads. In this case, grease leakage from the bearings can be further prevented by forming four notches 6*b* at the inner peripheral surface of the rear bearing support hole 32 at equal intervals, to thus provide equal pressure between the end chamber 28 and a rear space 33 of the bearing support hole.

While the invention has been described in detail and with reference to the specific embodiments thereof, it will be apparent to one skilled in the art that various changes and modifications can be made therein without departing from the spirit and scope thereof.

What is claimed is:

1. In a rotary fluid pump including a housing having a generally cylindrical cavity extending therethrough, a pair of recessed end heads assembled at opposite ends of the housing to form a pump cavity therewith, a drive shaft journalled in said end heads by bearings and extending into the interior of the pump cavity, a rotor mounted on the drive shaft within the pump cavity, a pair of sealing plates individually disposed between the ends of the housing and the end heads to divide the pump cavity into a pair of end chambers defined by the end heads and the sealing plates and an intermediate rotor chamber defined by the sealing plates and, a plurality of vanes slidingly disposed in grooves radially formed in the rotor, the improvement comprising;

said sealing plates being resilient to allow for deformation and extending from said drive shaft radially outward to said housing;

fluid inlet and discharge ports provided in the resilient sealing plates in fluid communication with said pump cavity, and wherein said resilient plates isolate said end chambers to prevent fluid communication between said ports and said end chambers.

2. The improvement of claim 1, wherein said fluid inlet and discharge ports are formed by protruding said resilient sealing plates toward said end chambers to provide concave space having random shapes.

3. The improvement of claims 1 or 2 further comprising fluid intake and discharge openings formed in said housing body, said openings in fluid communication with said rotor chamber through said fluid inlet and outlet ports, respectively.

4. The improvement of claim 1, further comprising a rear bearing support hole formed in the rear end head formed with at least one notch at an inner peripheral surface thereof to provide air communication between the end chamber and the bearing support hole.

5. The improvement of claim 1 wherein said fluid inlet and discharge ports are formed as recesses on inner faces of said resilient sealing plates.

6. The improvement of claim 5 further comprising fluid intake and discharge openings formed in said housing body and wherein said recesses forming said inlet and outlet ports establish fluid communication between said rotor chamber and said inlet and discharge openings, respectively.

7. The improvement of claims 1 or 2 wherein said fluid inlet and discharge ports are formed as outwardly extending openings extending into said end heads.

8. The improvement of claim 7 wherein said end heads have fluid intake and discharge openings respectively, said inlet and discharge ports coaxial with said openings and connector portions extending into said ports.

* * * * *